United States Patent [19]

Anderson et al.

[11] 4,345,870

[45] Aug. 24, 1982

[54] QUICK ATTACH LOADER

[75] Inventors: Carl M. Anderson; Vernon L. Losey, both of Claremore, Okla.

[73] Assignee: Hesston Corporation, Hesston, Kans.

[21] Appl. No.: 159,767

[22] Filed: Jun. 16, 1980

[51] Int. Cl.[3] ..... E02F 3/70

[52] U.S. Cl. ..... 414/686; 172/272; 172/274; 414/786

[58] Field of Search ..... 414/686, 786; 172/274, 172/275, 273, 272

[56] References Cited

U.S. PATENT DOCUMENTS

| | | | |
|---|---|---|---|
| 2,517,582 | 8/1950 | Lull . | |
| 2,701,072 | 2/1955 | Chambers et al. | |
| 2,784,656 | 3/1957 | Sheppard | 172/274 |
| 2,863,273 | 12/1958 | Turner . | |
| 2,972,424 | 2/1961 | Cadwell . | |
| 3,131,823 | 5/1964 | Foster et al. | |
| 3,255,903 | 6/1966 | Lofgren et al. | |
| 3,324,954 | 6/1967 | Westendorf . | |
| 3,554,396 | 1/1971 | Demkiw . | |
| 3,612,311 | 10/1971 | Eidy et al. | |
| 3,863,786 | 2/1975 | Frank | 414/686 |
| 3,912,095 | 10/1975 | Miller | 414/686 |
| 3,949,889 | 4/1976 | Moe | 414/686 |
| 3,991,890 | 11/1976 | Frank | 414/686 |
| 4,275,984 | 6/1981 | Lenertz | 172/274 X |

FOREIGN PATENT DOCUMENTS

| | | | |
|---|---|---|---|
| 655785 | 1/1963 | Canada . | |
| 1924269 | 11/1970 | Fed. Rep. of Germany | 414/686 |
| 1372650 | 12/1964 | France . | |

*Primary Examiner*—Bruce H. Stoner, Jr.

*Attorney, Agent, or Firm*—Schmidt, Johnson, Hovey & Williams

[57] ABSTRACT

A tractor and a loader implement detachably mounted thereon have releasable front and rear locks at corresponding pairs of legs depending from the loader frame. A loader bucket on the boom assembly and a stand on the frame cooperate to support the attachment after removal from the tractor. Hydraulic piston-cylinder assemblies, normally used to raise and lower the boom relative to the frame, are used to position the frame and to lower it into place during the mounting procedure. All parts of the attachment are guided properly onto the tractor without aid of the tractor or any parts thereon.

10 Claims, 11 Drawing Figures

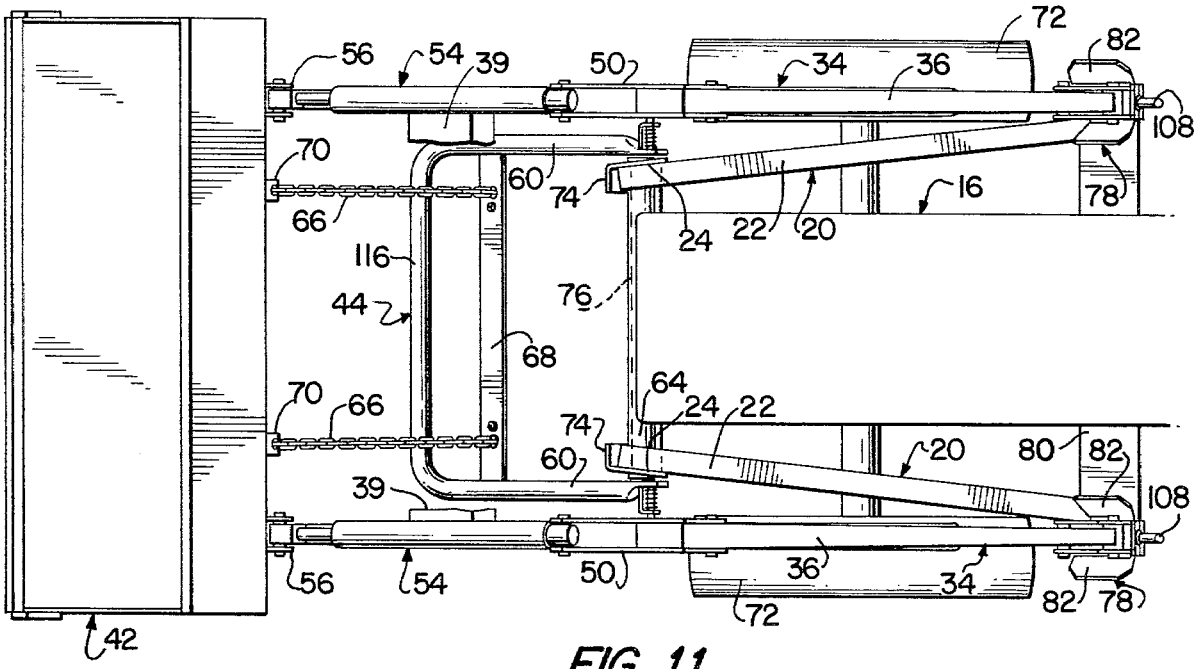
FIG. 11
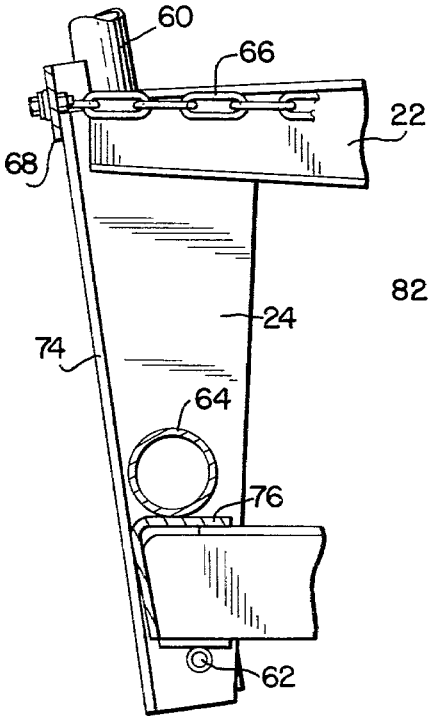
FIG. 3
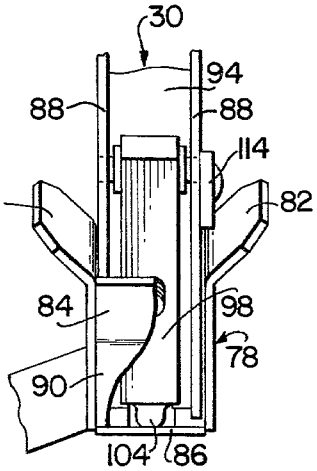
FIG. 5
FIG. 4
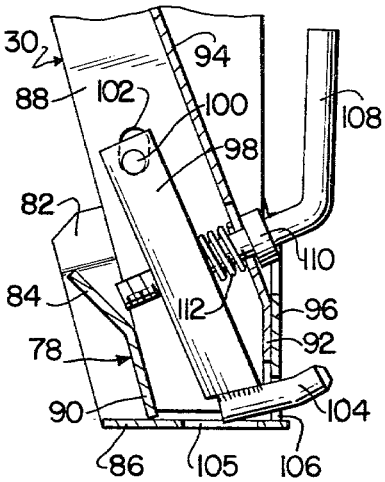
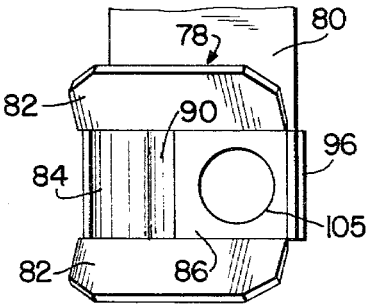
FIG. 6

QUICK ATTACH LOADER

The materials handling implement of our present invention, such as a front end loader attachment for tractors, is initially free standing and self supporting, resting on the scoop or bucket of the boom assembly and on an extension of the frame structure in the nature of a stand. Extensible, fluid pressure, piston and cylinder power devices between the frame and the boom function normally to raise and lower the material handling tool on the boom. However, the arrangement is such that when the loader is on the ground, detached from the tractor, those power devices are operable instead to swing the frame up and down while the bucket and the stand continue to rest on the ground in supporting relationship to the implement.

Within the path of swinging movement of the frame there is an intermediate position which is the exact location the frame must take when attached to the tractor. Therefore, it is but necessary to first raise the frame high enough to permit driving of the tractor beneath the implement. Then, without aid of the tractor, either by connection thereto or by engagement therewith, the frame is lowered to the required location on the tractor. Thereupon, the operator need only manipulate various locking elements to effect the attachment of the frame to the tractor.

We are aware of several patented suggestions utilizing frame parts or stands for rendering attachable implements free standing prior to mounting on tractors, and of the use of various types of pockets, channels or the like on the tractor into which certain parts of the frame are guided during the method steps of mounting and attachment. Examples of stands carried by the boom assembly are U.S. Pat. Nos. 2,701,072; 3,131,823 and 3,912,095. On the other hand, others have provided for stands which are carried by the boom supporting framework, e.g. U.S. Pat. Nos. 3,255,903; 3,324,954; 3,612,311 and 3,863,786, as well as France No. 1,372,650 of August, 1964. In lieu of stands, as such, U.S. Pat. Nos. 2,972,424 and 3,554,396 rely on the bucket and the frame itself to support the detached loader. Other examples of loaders with tractor-attached frames for supporting swingable boom assemblies are U.S. Pat. No. 2,517,582 and 2,863,273. And, in Canada No. 655,785 of January, 1963, a tillage implement is provided with a tongue received by a forwardly tapering bell housing on the tractor somewhat comparable to the teachings of U.S. Pat. Nos. 2,972,424 and 3,324,954 aforementioned.

In the drawings:

FIG. 3 is a fragmentary, cross sectional view taken on line 3—3 of FIG. 2;

FIG. 4 is an enlarged, fragmentary, vertical cross sectional view through one of the rear pockets showing the corresponding rear leg of the implement frame latched in place therewithin;

FIG. 5 is a fragmentary view showing the front of the pocket, parts being broken away for clearness;

FIG. 6 is a fragmentary plan view of the pocket;

FIG. 11 is a fragmentary plan view of the assembly as shown in FIG. 10.

Figure 7:
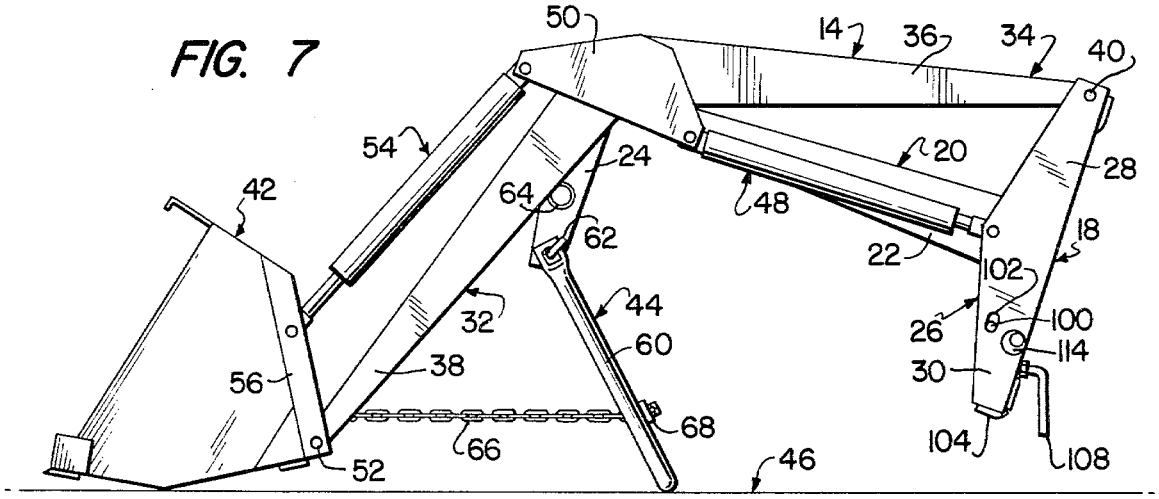
FIG. 7 is a view similar to FIG. 1 showing the implement detached from the tractor.

A materials handling implement 14 is shown by FIG. 7 in its free standing and self supporting condition, entirely separate from a tractor 16 illustrated diagrammatically by FIGS. 1 and 8–11. The implement 14 includes a frame structure 18 having a pair of identical, laterally spaced side units 20. Each unit 20 has an elongated, fore and aft bar 22 which, in turn, has a front leg 24 rigid thereto and depending therefrom. Also rigid to the bar 22 is a rear upright 26, presenting an upstanding post 28 and a rear leg 30 depending from the bar 22. The bars 22 converge as the legs 24 are approached (FIG. 11).

Figure 10:
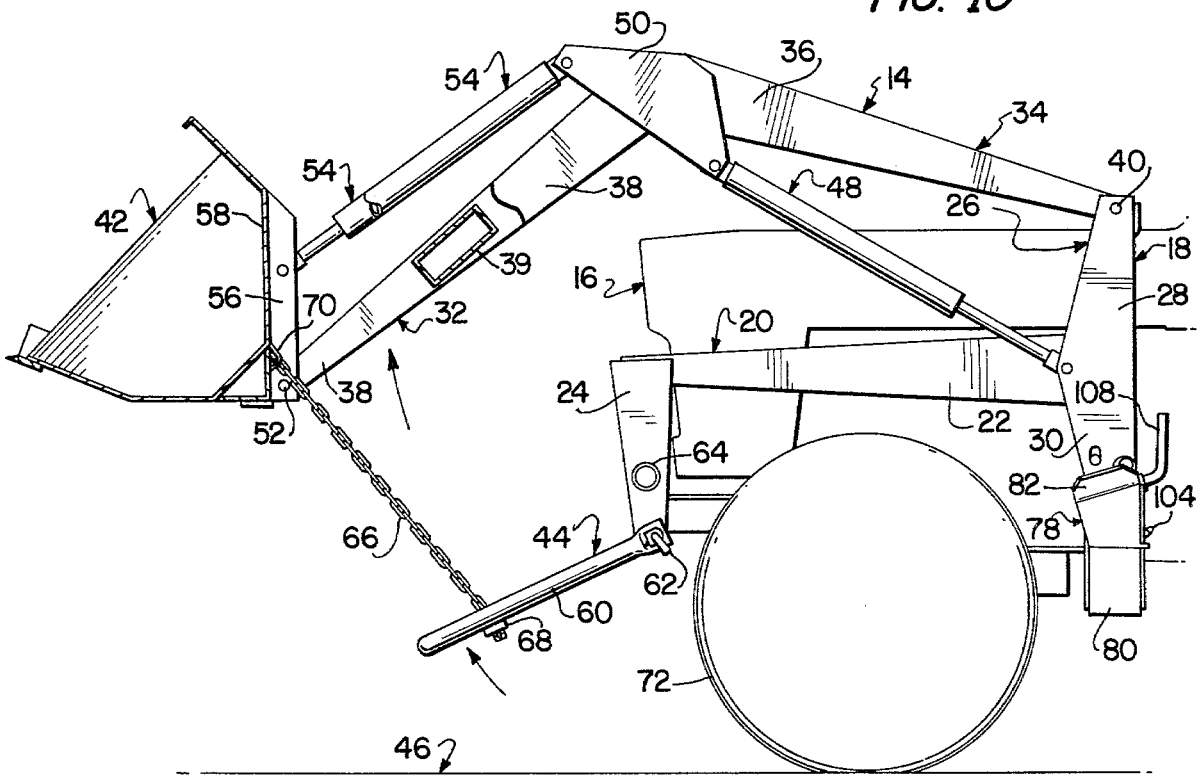
FIG. 10 is a view similar to FIG. 9 showing the stand being pulled from beneath the tractor.

A boom assembly 32 has a pair of identical, laterally spaced, parallel, lifting beams 34, each provided with a fore and aft rear arm 36 and a downwardly and forwardly extending front arm 38. The arms 38 have a connector 39 therebetween (FIG. 10). Pivot means 40 connect the rear ends of the arms 36 with the upper ends of the corresponding posts 28 for up and down swinging movement of the assembly 32 relative to the structure 18.

A materials handling tool 42, such as a loader bucket or scoop, is mounted on the forward ends of the arms 38. A stand 44 mounted on the lower ends of the legs 24 cooperates with the tool 42 in supporting the implement 14 on the ground 46 (FIG. 7).

Figure 8:
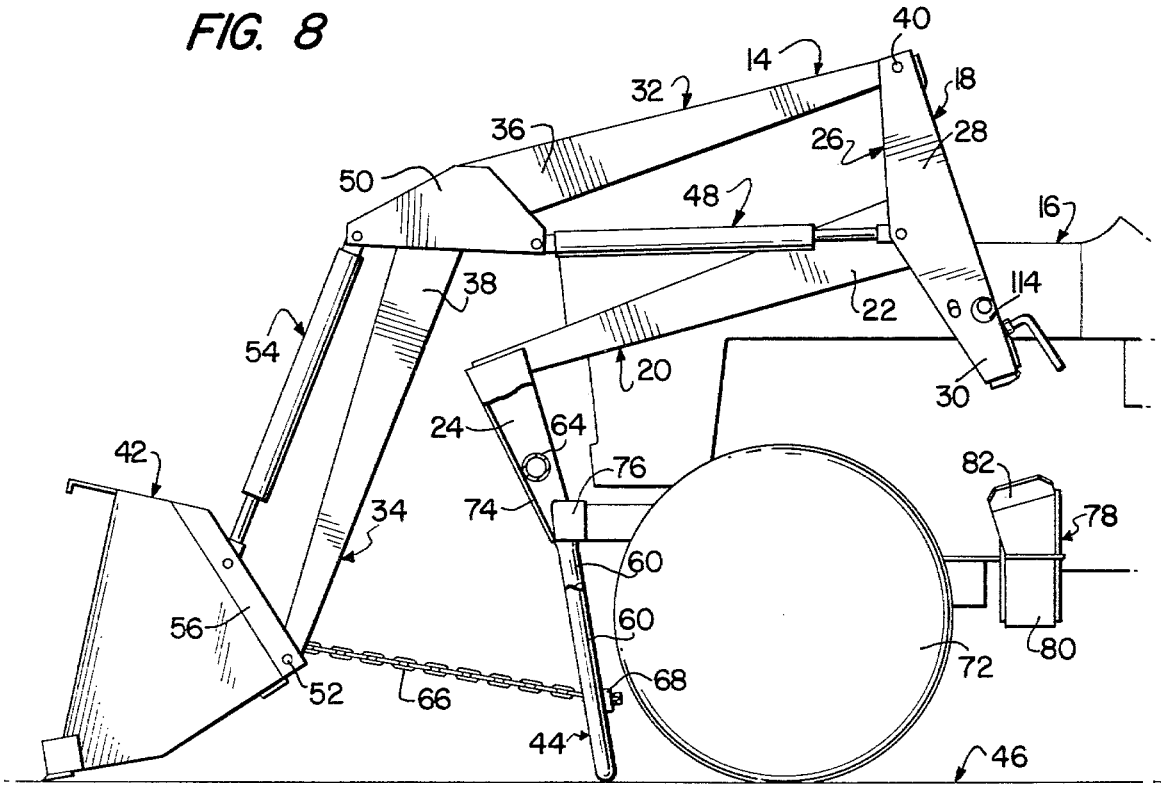
FIG. 8 is a view similar to FIG. 7 showing the position of the implement when the tractor is initially driven into position therebeneath.

Power means 48, such as a fluid pressure piston and cylinder device, interconnects each upright 26 with a corresponding beam 34 for raising and lowering the structure 18 and the arms 36 while the implement 14 is supported by the tool 42 and the stand 44 (compare FIGS. 7 and 8). More specifically, each device 48 is pivotally connected to its upright 26 adjacent the bar 22 at the zone of merger between the post 28 and the leg 30. Each beam 34 has a plate 50 rigid thereto at the zone of merger between the arms 36 and 38 and it is to those plates 50 that the parallel devices 48 are pivotally connected.

The bucket 42 has a pivotal connection 52 with each arm 38 such that it may be tilted through use of a pair of parallel power members 54, also in the nature of hydraulic pressure piston and cylinder devices. Each such device 54 is pivotally connected to one of the plates 50 and to a bracket 56 on rear wall 58 of the bucket 42, the brackets 56 also receiving the pivots 52 (FIGS. 10 and 11).

Figure 2:
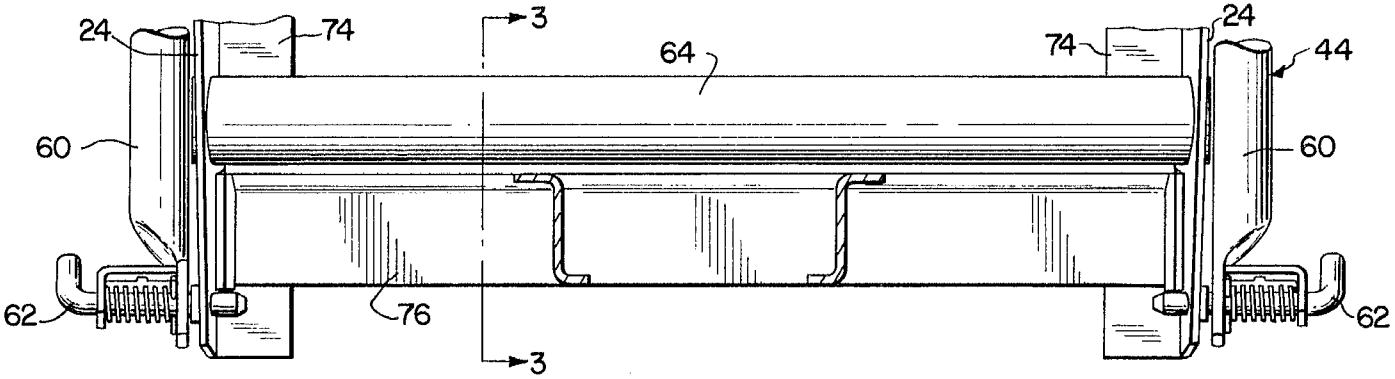
FIG. 2 is an enlarged, fragmentary, cross sectional view taken on line 2—2 of FIG. 1.

The U-shaped stand 44 has the upper ends of its two spaced supports 60 pivotally connected to the lower end of the legs 24 by L-shaped pins 62 (FIG. 2) disposed below a cross member 64 interconnecting the legs 24. A pair of chains 66, joined to a crossbar 68 between the supports 60, are releasably attached to projections 70 on the wall 58 having link-receiving slots for permitting the lengths of the chains 66 to be varied.

It is now clear from FIG. 7 that in storage or non-use, the implement 14 rests in a stable condition supported on the ground 46 by the bucket 42 and the stand 44 with the power means 48 retracted such that the frame structure 18 is in its lowered condition. The stand 44 is inclined rearwardly, presenting, in effect, an inverted V-shaped relationship between the arms 38 and the supports 60. The taut chains 66 hold the stand 44 against upward and rearward swinging movement about the pins 62.

Hence, it is but necessary to extend the power means 48 in order to swing the frame structure 18 to the position shown in FIG. 8 wherein the uprights 28 rise and tilt forwardly as the pivots 40 are approached, oppositely to the direction of tilt of the uprights 28 shown in FIG. 7. The legs 24 also tilt forwardly in FIG. 8 opposite to their direction of tilt depicted by FIG. 7. Further, the arms 36 now assume a slope downwardly toward the plates 50, and the bucket 42 is tipped forwardly. The cross member 64 rises slightly and the inclination of the stand 44 is reduced as it is pulled forwardly by the chains 66.

Noteworthy then is that the changes in the positions of the component parts of the implement 14 upon extension and retraction of the power means 48 takes place independently of and without aid of the tractor 16 and that, at all times, in FIG. 7 and in FIG. 8, the implement 14 remains free standing and self supporting. The result of the new attitude for the implement 14 in FIG. 8 is that the tractor 16 may now be driven forwardly into position where its front wheels 72 are disposed beneath the power means 48 (see also FIG. 11) limited by the legs 24.

As an aid to the operator of the tractor 16, the legs 24 are provided with inturned flanges 74 disposed for engagement by a crosspiece 76 on the tractor 16, such as its bumper. The flanges 74 serve, therefore, as gauges to determine the maximum extent to which the tractor 16 should be driven forwardly.

Figure 9:
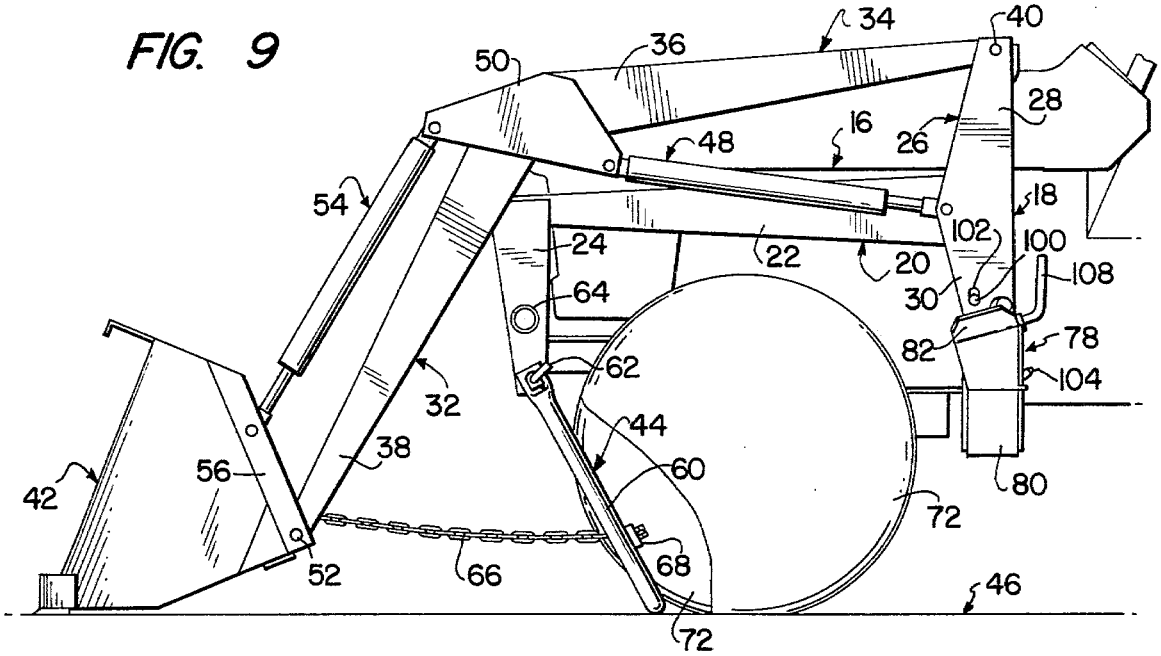
FIG. 9 is a view similar to FIG. 8 showing the implement on the tractor with the rear legs of the implement frame locked in place.

The power means 48 are now retracted to the position shown in FIG. 9 such that the component parts of the implement 14 assume a third intermediate position with the legs 24 and 30 lower than in FIG. 8 but higher than in FIG. 7. Such is the position (FIG. 9) in which the frame structure 18 remains after the implement 14 is attached to the tractor 16 and placed in use. The cross member 64 comes to rest upon the upper surface of the crosspiece 76, the bucket 42 assumes a third position on the ground 46, the chains 66 become slack and the stand 44 assumes an inclination somewhat similar to FIG. 7.

Now, if the crosspiece 76 is against the cross member 64, or nearly so, the legs 30 will swing into place within a pair of open top pockets 78, one on each side of the tractor 16 just to the rear of the wheels 72. The pockets 78 (detailed in FIGS. 4–6) are mounted on an underslung crosshead 80 secured to the chassis of the tractor 16, and each pocket 78 has a pair of outwardly flared guides 82 as well as a forwardly flared guide 84 for deflecting the legs 30 into the pockets 78.

When the legs 30 seat into the pockets 78 their lower, open ends remain spaced above bottom wall 86 of the pockets 78, the forward edges of their side webs 88 engage inclined front walls 90 of the pockets 78 and the lower portions 92 of their rear webs 94 engage upright rear walls 96 of the pockets 78 such as to become wedged into place fore and aft.

A latch 98 is swingable within each pocket 78 by a pin 100 adapted to rise and fall within slots 102 in the webs 88, and a prong 104 on the latch 98, cleared by an opening 105 in the wall 86, hooks into a hole 106 in the wall 96.

An L-shaped lock 108, accessible to an operator on the seat (not shown) of the tractor 16, passes through the web 94 and is screw-threaded into the latch 98. The web 94 is interposed between a shoulder 110 on the lock 108 and a spring 112 coiled around the lock 108.

The outer webs 88 are each provided with an adjustable disc 114 rotatably and eccentrically secured thereto for engagement with the outer flares 82 to laterally wedge the legs 30 into the pockets 78.

OPERATION

When the implement 14 is in the condition shown by FIG. 7, it is but necessary to drive the tractor 16 forwardly toward and to a position adjacent the uprights 26, whereupon the hydraulic pumping system of the tractor 16 (not shown) is operably coupled with the power means 48 and the power members 54. The power means 48 are then extended to raise the legs 24 and 30 to the condition shown in FIG. 8, clearing the crosspiece 76, the wheels 72 and the pockets 78.

The tractor 16 is then again advanced until the crosspiece 76 just touches the flanges 74 such that the position of the tractor 16 and the implement 14 relatively is such as to align the lower ends of the legs 30 with the upwardly facing, open mouths of the pockets 78 (see FIG. 8).

The power means 48 are then retracted, causing simultaneous tilting of the bucket 42 downwardly, seating of the legs 30 into the pockets 78 and movement of the cross member 64 downwardly and rearwardly onto the crosspiece 76 (see FIG. 9).

The operator, still on the seat of the tractor 16 actuating the hydraulic control valves (not shown), reaches down to turn the locks 108, compressing the springs 112 and swinging the latches 98 to extend their prongs 104 into the holes 106.

The next step is to extend the power means 48 as shown in FIG. 10 to cause the bucket 42 and the chains 66 to pull the stand 44 out from beneath the crosspiece 76. During movement of the stand 44 from the position shown in FIG. 9 to the position shown in FIG. 10 bight 116 of the stand 44 slides along the ground 46, raising the cross member 64 momentarily off the crosspiece 76. The bucket 42 and the stand 44 are then lowered to the ground 46, slackening the chains 66.

The operator then dismounts the tractor 16, turns the pin 62 to their unlocked positions, whereupon springs 118, coiled about the pins 62 (FIG. 2) force the latter into underlying relation to the crosspiece 76 to lock the cross member 64 against upward movement.

Figure 1:
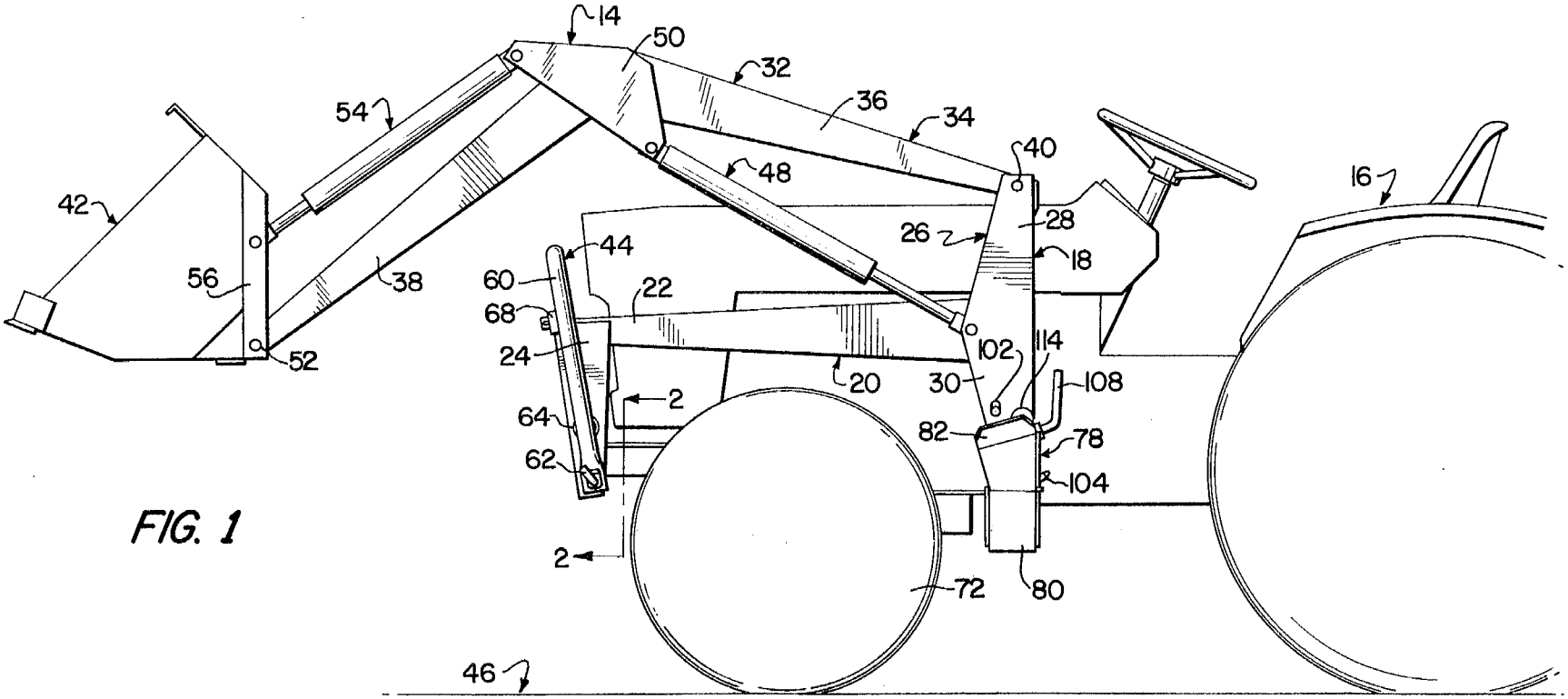
FIG. 1 is a side elevational view of a quick attach loader made according to our invention mounted on a tractor and ready for use.

The chains 66 are then released from the projections 70 and the stand 44 is swung upwardly to the position shown in FIGS. 1 and 3. The chains 66 are extended rearwardly and fastened to the structure 18 in any suitable manner (not shown) to hold the stand 44 in front of the tractor 16.

Alternately, the pins 62 may be first locked beneath the crosspiece 76; then as the stand 44 is pulled upwardly the front end of the tractor 16 will be raised slightly as the stand 44 is moved to the position shown in FIG. 10.

During use of the implement 14 on the tractor 16, the power means 48 and the power members 54 are used in a manner well known in this art (see FIG. 1). Removal of the implement 14 from the tractor 16 requires the mere reversal of the mounting steps above outlined.

We claim:

1. In combination with a tractor having a front mounting means and a pair of intermediate mounting means, one on each side respectively of the tractor, a materials handling implement including:

a frame structure having a pair of laterally spaced, interconnected side units, each unit including an elongated, fore and aft bar having a front leg secured thereto and depending therefrom and a rear upright secured thereto, each upright being provided with an upstanding post and a rear leg depending from the bar;

a boom assembly having a pair of laterally spaced, interconnected lifting beams, each beam including a fore and aft rear arm and a forwardly extending front arm;

pivot means connecting the rear ends of the rear arms with the upper ends of the corresponding posts for up and down swinging movement of said assembly relative to said structure;

a materials handling tool mounted on the forward ends of said front arms;

a stand mounted on the lower ends of said front legs and cooperable with said tool in rendering the implement free standing and self supporting; and power means interconnecting each upright with a corresponding beam for raising and lowering said structure and said rear arms while the implement is supported by said tool and said stand, the lower end of each front leg having means releasably attaching the same to said front mounting means, and the lower end of each rear leg having means releasably attaching the same to the corresponding intermediate mounting means after said structure and the rear legs are lowered, said front mounting means comprising a crosspiece, said front legs having a cross member interconnecting the same and resting on the crosspiece.

2. The invention of claim 1; and pivot means swingably mounting the stand on the front legs and releasably locking the cross member to the crosspiece.

3. The invention of claim 2; and means connected with the stand for swinging the latter forwardly and upwardly from beneath the front legs upon actuation of the power means after the rear legs are attached to said intermediate mounting means.

4. The invention of claim 1, each intermediate mounting means including an open top pocket into which the corresponding rear leg is inserted.

5. The invention of claim 4, each rear leg having a latch swingable thereon and extending into the corresponding pocket, said latches having prongs locking the rear legs to the pockets.

6. The method of mounting a materials handling implement on a tractor, said implement having a frame structure provided with a stand depending from its forward end, a boom assembly mounted on said structure for up and down swinging movement, a materials handling tool carried by said assembly, and power means between said structure and said assembly for swinging the latter, said implement being ground supported by the bucket and the stand when the implement is detached from the tractor, said method including the steps of:

driving the tractor forwardly to position its front end adjacent the stand;

actuating the power means to swing said structure downwardly while the implement is supported by the tool and the stand until said structure engages the tractor at a number of locations on the latter; and attaching the structure to the tractor at each of said locations, said structure having a front cross member and a pair of spaced rear legs, said tractor having a front crosspiece and a pair of spaced pockets, said method including the downward swinging of said structure until the rear legs enter the pockets and the cross member descends toward and comes to rest on the top of the crosspiece at substantially the same time.

7. The invention of claim 6; and raising the stand off the ground.

8. The invention of claim 6; and raising the stand and the bucket off the ground at substantially the same time.

9. The invention of claim 6, the bucket being connected to the stand; and actuating the power means to raise the bucket off the ground and to thereby raise the stand off the ground.

10. The invention of claim 6, said structure having a pair of front legs depending from said cross member, the stand being swingable on the front legs, said attaching step including clamping of the cross member to the crosspiece; and swinging the stand off the ground after the legs enter the pockets and the cross member comes to rest on the crosspiece.

* * * * *